US008096241B2

(12) United States Patent
Steinbacher

(10) Patent No.: US 8,096,241 B2
(45) Date of Patent: Jan. 17, 2012

(54) METHOD FOR CUT-OFF REGISTER CONTROL

(75) Inventor: Eduard Steinbacher, Augsburg (DE)

(73) Assignee: manroland AG, Offenbach am Main (DE)

( * ) Notice: Subject to any disclaimer, the term of this patent is extended or adjusted under 35 U.S.C. 154(b) by 1030 days.

(21) Appl. No.: 12/009,963

(22) Filed: Jan. 23, 2008

(65) Prior Publication Data

US 2008/0179389 A1 Jul. 31, 2008

(30) Foreign Application Priority Data

Jan. 24, 2007 (DE) ..... 10 2007 003 488

(51) Int. Cl.
*B41L 1/02* (2006.01)
*B41L 3/02* (2006.01)

(52) U.S. Cl. ..... 101/485; 101/486

(58) Field of Classification Search ..... 101/485, 101/486

See application file for complete search history.

(56) References Cited

U.S. PATENT DOCUMENTS

| | | | | |
|---|---|---|---|---|
| 3,843,440 | A * | 10/1974 | Davies | 156/354 |
| 3,955,502 | A | 5/1976 | von Hofe | |
| 4,896,605 | A * | 1/1990 | Schroder | 101/486 |
| 5,452,632 | A * | 9/1995 | Durr et al. | 83/13 |
| 5,458,062 | A | 10/1995 | Goldberg et al. | |
| 5,546,859 | A * | 8/1996 | Hern | 101/226 |
| 6,050,192 | A | 4/2000 | Kipphan et al. | |
| 6,779,454 | B2 | 8/2004 | Mengisen et al. | |
| 2006/0199718 | A1 | 9/2006 | Thoma | |
| 2006/0207452 | A1 | 9/2006 | Budach et al. | |
| 2007/0002019 | A1 * | 1/2007 | Lane et al. | 345/163 |
| 2009/0237641 | A1 * | 9/2009 | Mooney | 356/28 |

FOREIGN PATENT DOCUMENTS

| | | | |
|---|---|---|---|
| DE | 199 17 774 | | 11/1999 |
| EP | 1 287 988 | | 3/2002 |
| JP | 63139785 | A * | 6/1988 |

* cited by examiner

*Primary Examiner* — Ren Yan
*Assistant Examiner* — Allister Primo
(74) *Attorney, Agent, or Firm* — Cozen O'Connor

(57) ABSTRACT

A method for controlling cut-off registration in a printing press having printed webs includes applying print control marks which are invisible to the human eye to the printed webs; passing the webs pass through cut-off register control actuators; assembling the webs into a bundle for cut-off; scanning the webs with sensors to determine the actual positions of the marks; comparing the actual positions with desired positions of the marks; and generating signals for the cut-off register control actuators based on the comparison.

10 Claims, 1 Drawing Sheet

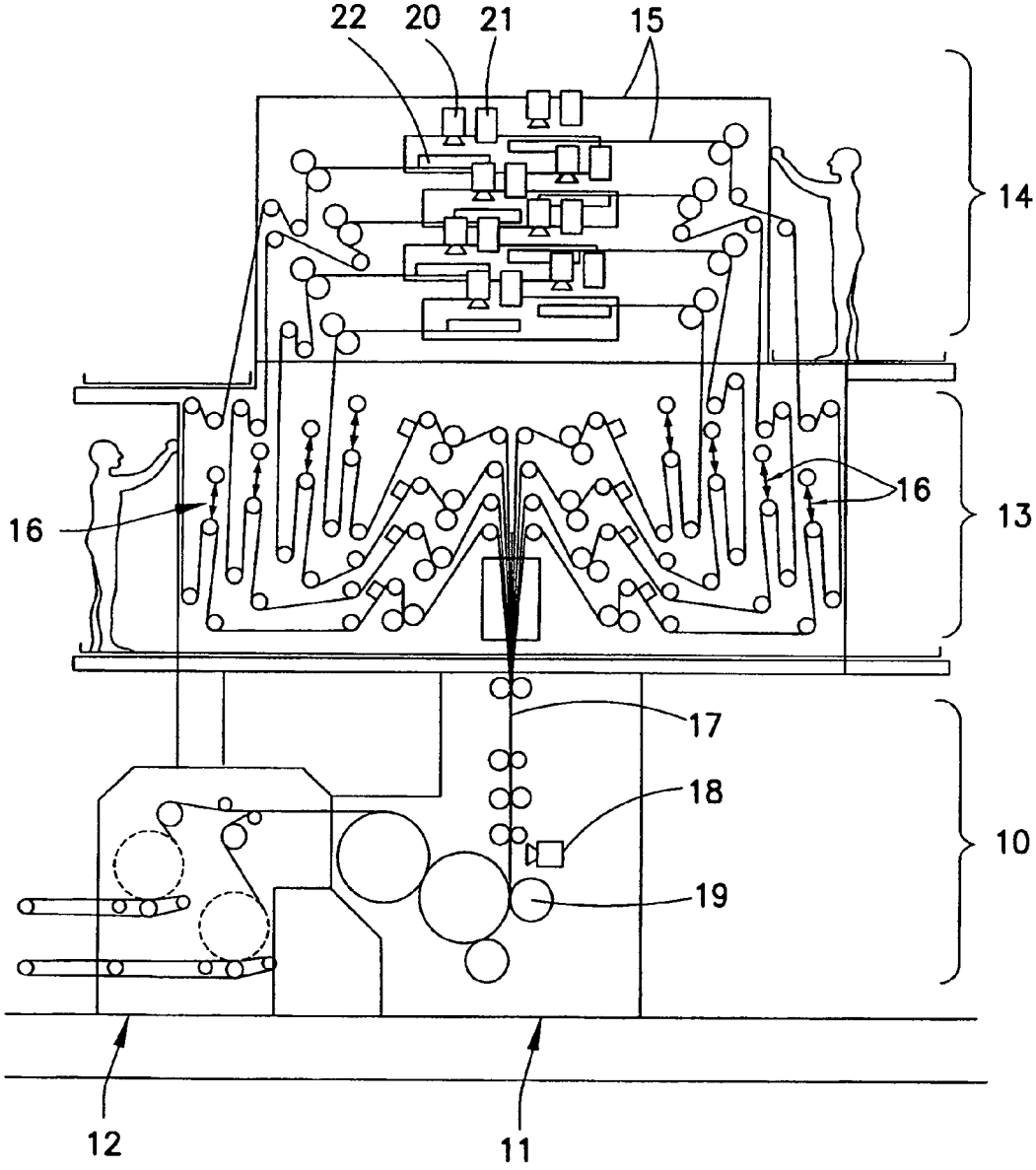
22
20
21
15
14
16
16
13
17
18
10
19
12
11

METHOD FOR CUT-OFF REGISTER CONTROL

BACKGROUND OF THE INVENTION

1. Field of the Invention

The invention pertains to a method for controlling the cut-off register wherein print control marks applied to a printed substrate are scanned to determine the actual positions of the marks, and the actual positions are compared with desired values to generate actuating signals for cut-off register control actuators.

2. Description of the Related Art

The cut-off register is usually controlled by the use of print control marks printed on the printed product. These marks are detected by sensors, and the actual values of the print control marks thus detected are compared with desired values for the print control marks, so that, on the basis of this comparison, actuating signals can be generated for controlling the cut-off register. These types of print control marks, which are printed on the product outside the actual printed image or subject, are undesirable especially in the case of newspaper printing, because in the case of newspapers the printed product is not cut and thus the print control marks are visible in the end product.

U.S. Pat. No. 6,779,454 discloses a process for cut-off register control on a printing press which does not work with marks. Here the printed image on the product is scanned by sensors. The actual values thus obtained are compared with desired values, which are based on image data or preliminary-stage printing data. In the case of markless cut-off register control using desired values based on preliminary-stage printing data, large amounts of data must be processed, the exact amount depending on the resolution of the preliminary data. Efficiency thus suffers. If preliminary-stage printing data of lower resolution are used, the control accuracy which can be achieved suffers.

SUMMARY OF THE INVENTION

Against this background, the present invention is based on the task of creating a novel method for cut-off register control.

According to the invention, print control marks invisible to the human eye are applied to the substrate.

The inventive process for cut-off register control offers the advantage that no print control marks perceived as undesirable are visible in the end product. The inventive process for cut-off register control also offers the advantage that only a relatively small amount of data needs to be processed for control purposes. A high degree of control accuracy can also be realized.

It is preferable to apply temporary or ephemeral or volatile print control marks to the substrate. These are preferably thermal print control marks, which are produced by heating the substrate locally by means of a laser.

According to an advantageous elaboration of the invention, the print control marks are applied to the substrate before several strands of substrate are assembled and thus cover each other. Different print control marks are applied to each strand of the substrate.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The sole FIGURE shows part of a web-fed press for the purpose of illustrating the inventive process of cut-off register control.

DETAILED DESCRIPTION OF THE PRESENTLY PREFERRED EMBODIMENTS

The FIGURE shows part of a web-fed press in the area of a folder 10, which includes a cross-folding unit 11 and a delivery unit 12 downline from the cross-folding unit 11. A magazine assembly 13 and a turner assembly 14 are installed upline from the folder 10.

According to the FIGURE, several strands 15 of substrate are turned 90° in the turner assembly 14 on the turner bars 22 of the turner assembly 14, and after they have been turned they are sent to the magazine assembly 13. Several actuators 16 for cut-off register control are integrated into the magazine assembly 13. In the exemplary embodiment according to FIG. 1, a total of eight substrate strands 15 are turned in the turner assembly 14, where the magazine assembly 13 comprises a separate cut-off register control actuator 16 for each one of these eight strands 15.

Before the substrate strands 15 enter the cross-folding unit 11 of the folder 10, the substrate strands 15 are assembled into a strand bundle 17; that is, all of the substrate strands 15 are brought together and laid on top of each other, thus covering each other. The strand bundle 17 is then sent to a cutting knife cylinder 19 in the cross-folding unit 11, where the individual copies are separated by the cross-cutting of the strand bundle 17 in the area of the cutting knife cylinder 19. After the copies have been separated from the strand bundle 17 by the cutting knife cylinder 19, they are given at least one cross-fold in the cross-folding unit 11, and after they have been cross-folded, they are discharged from the printing press in the area of the delivery unit 12.

At this point it should be pointed out that the structure shown in the FIGURE is merely an example. It is therefore possible to install a quarter-folding unit between the magazine assembly 13 and the cross-folding unit 11. A quarter-folding unit could also be installed between the cross-folding unit 11 and the delivery unit 12. The number of substrate strands 15 to be handled can also be varied as desired.

When the copies are being separated from the strand bundle 17 by cross-cutting in the area of the cutting knife cylinder 19, it is important that the cross-cutting occur in the correct position of the strand bundle 17. The inventive process for cut-off register control serves precisely this purpose. In particular, it is important that all of the substrate strands 15 of the strand bundle 17 be aligned precisely with respect to each other and that, when a copy is separated from the strand bundle 17, that the cross-cutting occur in the correct position for all of the substrate strands 15 of the strand bundle 17.

In accordance with the present invention, it is proposed that print control marks invisible to the human eye be applied to the substrate, that is, to the substrate strands 15. These print control marks invisible to the human eye can consist exclusively of print control marks which are visible only in the ultraviolet range of the spectrum and which are applied permanently to the substrate strands 15.

Preferably, however, temporary or ephemeral or volatile print control marks invisible to the human eye are applied to the substrate, that is, to the substrate strands 15. These temporary print control marks are thermal print control marks, or alternatively they can be radioactive print control marks. The inventive process for the preferred case is described below, according to which thermal print control marks are applied to the substrate strands 15.

The application of temporary thermal print control marks to the substrate strands 15 is accomplished in the exemplary embodiment according to FIG. 1 shown here in the area of the turner assembly 14 by means of print control mark applicators 21, preferably designed as lasers, where an individual print control mark applicator 21 is assigned to each strand 15 of substrate.

Before the thermal print control marks are applied by means of the print control mark applicators 21, each substrate stand 15 is scanned by a sensor 20 assigned to the associated substrate strand 15 to determine the position where the print control marks are to be applied to the associated substrate strand by the associated print control mark applicator 21. The print control marks are then applied upstream, looking in the transport direction of the substrate strands 15, of the cut-off register control actuators 16.

The thermal and thus temporary print control marks invisible to the human eye applied to the substrate strands 15 in the area of the turner assembly 14 are scanned by a sensor 18. The sensor 18 is integrated into the cross-folding unit 11 of the folder 10 immediately upstream, looking in the transport direction of the strand bundle 17, of the cutting knife cylinder 19 of the cross-folding unit 11.

The positioning of the sensor 18 for scanning the print control marks immediately upstream of the cutting knife cylinder 19 is important for guaranteeing a high degree of control accuracy of the cut-off register control. Although many substrate strands 15 in the strand bundle 17 are covered and thus not visible in the area of the sensor 18, through the use of thermal or even radioactive print control marks, it is nevertheless possible, with the help of the sensor 18, which is preferably designed as a thermal imaging camera, to detect the position of the print control marks in question on the covered substrate strands 15. To facilitate the control of the cut-off register, it is preferable to apply different print control marks to each substrate strand 15, so that the marks on one strand differ from the print control marks on the other substrate strands by, for example, their external form and thus by their geometry.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for controlling cut-off registration in a printing press having printed webs which pass through respective cut-off register control actuators and are assembled into a bundle for cut-off, the method comprising:

applying print control marks which are invisible to the human eye to each said printed web;

scanning the webs with sensors to determine the actual positions of the marks;

comparing actual positions with desired positions of the marks;

generating signals for the cut-off register control actuators based on the comparison; and scanning printed images on the web prior to applying the print control marks, the print control marks being applied as a function of the scanning of the printed images, wherein the webs pass through the cut-off register control actuators downstream of applying the print control marks.

2. The method of claim 1 wherein the print control marks are visible only in ultraviolet light.

3. The method of claim 1 wherein the print control marks are temporarily detectable.

4. The method of claim 1 wherein the print control marks are thermal print control marks.

5. The method of claim 1 wherein the print control marks are radioactive.

6. The method of claim 1 wherein the webs are assembled into a bundle downstream of applying the print control marks, the webs being assembled so that they cover each other.

7. The method of claim 6 wherein the print control marks are used to control the cut-off registers of the covered webs.

8. The method of claim 1 wherein the scanning of the webs with sensors to determine the actual positions of the marks is performed downstream of the cut-off register control actuators.

9. The method of claim 8 further comprising cutting the bundle by means of a cutting knife cylinder immediately downstream of scanning the webs with sensors to determine the actual positions of the marks.

10. The method of claim 4 wherein the thermal print control marks are scanned by heat sensors to determine the actual positions of the marks.

* * * * *